US005605069A

United States Patent [19]

Jentzsch

[11] Patent Number: 5,605,069

[45] Date of Patent: Feb. 25, 1997

[54] BEVERAGE CONTAINER WITH WAVY TRANSITION WALL GEOMETRY AND METHOD FOR PRODUCING THE SAME

[75] Inventor: K. Reed Jentzsch, Arvada, Colo.

[73] Assignee: Ball Corporation, Muncie, Ind.

[21] Appl. No.: 421,432

[22] Filed: Apr. 12, 1995

[51] Int. Cl.[6] ..... B21D 22/00; B21D 22/21

[52] U.S. Cl. ..... 72/347; 72/348; 72/349

[58] Field of Search ..... 72/348, 347, 349, 72/379.4, 377

[56] References Cited

U.S. PATENT DOCUMENTS

| | | | |
|---|---|---|---|
| 163,747 | 5/1875 | Cummings . | |
| 3,095,111 | 11/1960 | Mulder | 220/66 |
| 3,170,586 | 2/1965 | Bulgrin | 220/5 |
| 3,995,572 | 12/1976 | Saunders | 113/120 |
| 4,414,836 | 11/1983 | Saunders | 72/348 |
| 4,442,944 | 4/1984 | Yoshino et al. | 215/1 |
| 4,713,958 | 12/1987 | Bulso, Jr. et al. | 72/348 |
| 4,722,215 | 2/1988 | Taube et al. | 72/349 |
| 4,732,292 | 3/1988 | Supik | 230/70 |
| 4,834,256 | 5/1989 | McMillin | 220/66 |
| 4,836,398 | 6/1989 | Leftault, Jr. et al. | 220/66 |
| 5,125,257 | 6/1992 | Worwag et al. | 72/348 |
| 5,301,534 | 4/1994 | Nishikawa et al. | 72/348 |

FOREIGN PATENT DOCUMENTS 2398-669 3/1979 France .

*Primary Examiner*—Lowell A. Larson
*Assistant Examiner*—Rodney A. Butler
*Attorney, Agent, or Firm*—Sheridan Ross P.C.

[57] ABSTRACT

A metal drawn and ironed container body having a sidewall, an annular neck integrally formed with the sidewall and extending upwardly and inwardly from an upper end of the sidewall, and a bottom integrally formed with and diposed adjacent a lower end of the sidewall. The bottom includes an annular convex support, an annular transition wall interconnecting the lower end of the sidewall to the convex support, and a generally concave center panel extending upwardly and inwardly relative to the convex support. The transition wall includes a first convex annular portion extending generally downwardly and inwardly from the lower end of the sidewall, a first concave annular portion extending generally downwardly and inwardly from the first convex annular portion, a second convex annular portion extending downwardly and inwardly from the first concave annular portion, and a second concave annular portion extending downwardly and inwardly from the second convex annular portion.

22 Claims, 7 Drawing Sheets

BEVERAGE CONTAINER WITH WAVY TRANSITION WALL GEOMETRY AND METHOD FOR PRODUCING THE SAME

FIELD OF THE INVENTION

The present invention generally relates to metal beverage container bodies of the type which are drawn and ironed to form a seamless sidewall and a bottom formed integrally therewith. More specifically, the present invention relates to an transition wall geometry that enhances one or more aspects of the process for forming the beverage container.

BACKGROUND OF THE INVENTION

In the beverage packaging industry, beverage containers are typically manufactured in at least two parts: a container body and at least one container end. Typically, the container body is formed by drawing and ironing a sheet of metal into a cup-shaped container body. Container bodies and separate end pieces are shipped to a beverage filler. The filler provides a beverage to each container body and thereafter secures a separate container end to the open end of the body.

In forming the drawn and ironed container body from sheet metal stock, a multi-stage process is typically used. In one procedure, a circular disc is punched from a piece of sheet metal stock and provided to a drawing apparatus comprising a draw die and a draw punch. The circular disk is positioned over the upwardly open cylindrical cavity of the draw die, and is forcibly driven into the cavity by the draw punch to form a cup. The cup is then provided to a redrawing and ironing apparatus to form a container body having the desired specifications. More specifically, the cup is positioned over a redraw die and is forcibly driven therethrough by a forming punch attached to a ram. The redraw die reduces the inner and outer diameter of the cup to approximately the dimensions required for the container body. The redrawn cup is then passed through a series of ironing rings to further reduce the sidewall thickness of the redrawn cup. After passing through the last ironing ring, the end of the container body engages an outer die to form a transition wall of the container body. An inner die is subsequently advanced toward the container body to form a center panel and a nose into the bottom of the container body. The punch is subsequently retracted, and the formed container body is removed from the punch in an appropriate manner, such as by stripping (e.g., using forced air and/or fingers which engage the sidewall of the container body).

During the formation of the center panel in the bottom of the container body, material in the container body is pulled downwardly along the lower end of the sidewall and along the transition wall to provide sufficient material for formation of the center panel. This process is commonly referred to as "pulldown" of the sidewall. During pulldown of the sidewall, the material must flow from the larger diameter of the sidewall, through the transition wall, to the smaller diameter of the nose. Such change in diameter can result in wrinkling problems. Wrinkling problems have been compounded by the recent trend in reducing the diameter of the nose of container bodies, thereby resulting in a larger reduction in diameter from the sidewall to the nose.

Wrinkling can typically be remedied by increasing the force exerted by the outer die against the punch. However, such increase in force can result in excessive thinning of the wall thickness in the inner wall of the container body between the nose and the center panel. In addition, high outer die forces can increase the energy required to produce the container body, increase wear on the surfaces of the dies, and significantly reduce the life of the bodymaker mechanisms.

Accordingly, it is an object of the present invention to provide an apparatus and method for producing container bodies in a more energy-efficient, cost-effective manner. It is another object of the present invention to provide a container body configuration which can be readily produced and which facilitates energy-efficient and cost-effective production thereof. It is a related object to provide such a container body which allows for a reduction in the outer die forces required to produce a satisfactory container body.

SUMMARY OF THE INVENTION

In one aspect, the present invention is directed to an improved metal drawn and ironed beverage container body which is designed to satisfy one or more of the above-noted objects. The container body generally comprises a sidewall disposed substantially circumferentially about a central axis, an annular neck integrally formed with the sidewall and extending upwardly from an upper end of the sidewall and inwardly toward the axis, and a bottom integrally formed with and disposed adjacent a lower end of said sidewall. The bottom includes an annular convex support, an annular transition wall interconnecting the lower end of the sidewall to the convex support, and a generally concave center panel extending upwardly and inwardly within the container. In accordance with the present invention, the transition wall includes a first convex annular portion extending downwardly and inwardly from the lower end of the sidewall, a first concave annular portion extending downwardly and inwardly from the first convex annular portion, a second convex annular portion extending downwardly and inwardly from the first concave annular portion, and a second concave annular portion extending downwardly and inwardly from the second convex annular portion.

By virtue of the present invention, the manufacturability of the container body is significantly improved. More specifically, the material in the transition wall is less likely to wrinkle when being pulled down and reduced in diameter during formation of the center panel in the container bottom. Without being bound by any theory, it is believed that the reduction in wrinkling is a result of maintaining the material in control by passing it through a series of small radii which assists in required stretching and/or thickening of the material during diameter reduction. It has also been found that, by practicing the present invention and contrary to expectations, the outer die force associated with formation of the transition wall can be reduced without an increase in wrinkling. Such reduction in outer die force decreases die wear and is believed to increase the life of bodymaker mechanisms. Furthermore, reduction in outer die force reduces the occurrence of excessive material thinning in the inner wall.

In one embodiment of the present invention, the generally concave center panel comprises an annular outer portion upwardly extending from the inner wall located between the center panel and the convex support. All remaining parts of the center panel are disposed at least as upwardly as an upper end of the outer portion. Preferably, the center panel is substantially dome-shaped. Such a configuration is beneficial in improving dome reversal strength, which is important in the beverage container industry. In another embodiment, a transition wall angle between a tangent line, tangent to both the first and second convex annular portions, and the central axis is from about 35° to about 65°. Preferably, the transition wall angle is from about 40° to about 60°, and more preferably such angle is about 56°. In yet another embodiment, the tapered neck is dimensioned to facilitate securement of a reduced diameter (e.g., less than the diameter of the sidewall) container end thereto.

The present invention is particularly applicable to beverage container bodies having configurations associated with thin-walled drawn and ironed beverage container bodies. For example, in one embodiment, the sidewall is substantially cylindrical, and has a diameter less than about 2.7 inches. Moreover, at least a portion of the sidewall may have a wall thickness which is less than about 0.005 inches. In addition, the annular convex support, at its lowest point where it would contact a supporting surface, preferably has a diameter less than about 2.0 inches.

The concave and convex portions of the transition wall may have a range of dimensions without detracting from the beneficial features of the present invention. In one embodiment, for example, the first convex portion has a radius from about 0.05 inches to about 0.35 inches, and preferably a radius of about 0.15 inches. Also, the first concave portion may have a radius from about 0.04 inches to about 0.20 inches, preferably a radius from about 0.07 to about 0.15, and more preferably a radius of about 0.10 inches. In addition, the second convex portion may have a radius from about 0.04 inches to about 0.5 inches, and preferably a radius of about 0.15 inches. Moreover, the second concave portion may have a radius from about 0.04 inches to about 0.20 inches, and preferably a radius of about 0.15 inches.

In another aspect of the present invention, a method for forming a metal beverage container body from a metal blank is provided. The method generally-comprises the steps of drawing the blank to form a cup having a sidewall and an integral bottom, ironing the sidewall of the cup to reduce the wall thickness thereof, forming at least two annular concave portions in a transition wall of the cup bottom, upwardly forming a center panel into the cup bottom, and pulling down material through the annular concave portions of the transition wall. By virtue of the above-described process, the container body can be produced utilizing lower outer die force without an increase in wrinkling in the transition wall. Lower outer die force is expected to reduce die wear and should result in an increase of the life of bodymaker mechanisms, as described above. In addition, reduced problems associated with excessive thinning in the inner wall of the container body are expected.

In one embodiment, the method further includes, after the drawing step, the step of redrawing the cup through a redraw die. The redrawing step may, for example, include positioning the cup in alignment with a redraw die and advancing a punch to force the cup through the redraw die to reduce the diameter of the cup. In addition, the step of ironing may reduce the wall thickness of the cup to less than about 0.0045 inches.

In another embodiment, the step of forming at least two annular concave portions comprises engaging the transition wall of the cup bottom with an outer die at a force of less than about 1,000 $lb_f$, preferably less than about 500 $lb_f$. Also, the step of upwardly forming a center panel preferably comprises forming a generally concave panel (e.g., a substantially dome-shaped center panel) into the cup bottom. Furthermore, the step of pulling down may comprise pulling down material a distance of at least about 0.1 inches. The method may further include the step of forming a tapered neck into an upper end of the sidewall.

In another aspect, a method according to the present invention comprises the steps of drawing a blank to form a cup having a sidewall and an integral bottom, ironing the sidewall of the cup to reduce the wall thickness thereof, engaging a transition wall of the cup bottom with an outer die at a force of less than about 1,000 $lb_f$, and upwardly forming a center panel into the cup bottom.

The above-described method may be practiced in many different embodiments. For example, in one embodiment, the outer die force is less than about 500 $lb_f$. In another embodiment, the step of engaging the transition wall comprises forming at least two annular concave portions in the transition wall of the cup bottom. Moreover, the step of ironing may comprise reducing the wall thickness of the cup to less than about 0.0045 inches.

Additional steps may be added to the method. For example, the method may further include the step of pulling down material (e.g., at least about 0.01 inches) through the annular concave portions of the transition wall. Also, the method may include, after the drawing step, the step of redrawing the cup through.a redraw die. In one embodiment, the redrawing step comprises positioning the cup in alignment with a redraw die and advancing a punch to force the cup through the redraw die to reduce the diameter of the cup. The method may further comprise forming a tapered neck into an upper end of the sidewall.

DETAILED DESCRIPTION

Figure 1:
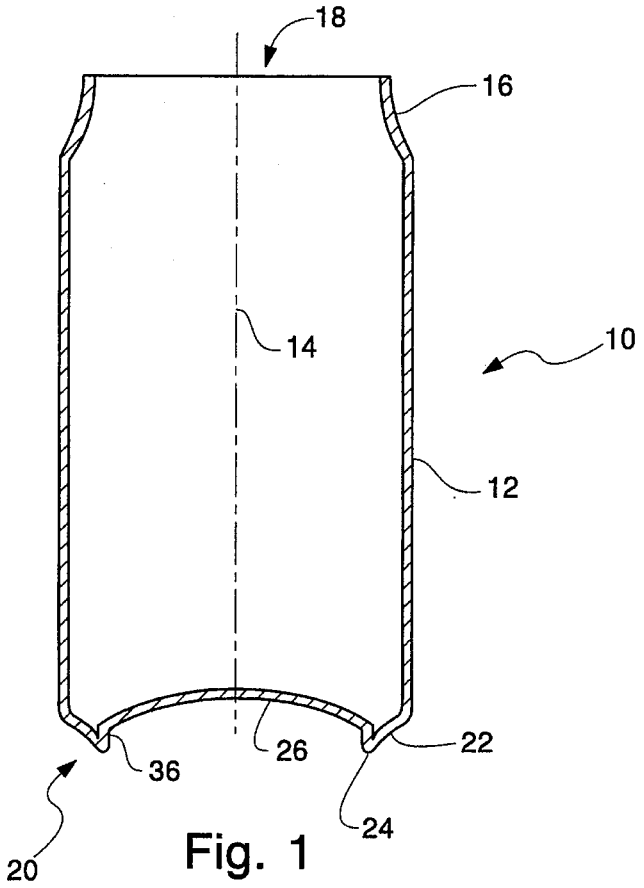
Fig. 1 (PRIOR ART)
FIG. 1 is a section view of a prior art container body.

FIG. 1 illustrates a cross-section of a typical prior art container body 10. The container body 10 generally comprises a cylindrical sidewall 12 defining a central axis 14 concentric therewith. A tapered neck 16 extends upwardly and inwardly (i.e., toward the central axis 14) from an upper end of the sidewall 12 and forms the open end 18 of the container body 10. The tapered neck 16 can be configured to facilitate securement of a small diameter (i.e., smaller than the diameter of the cylindrical sidewall 12) container end (not shown) thereon. The container body 10 further comprises a bottom 20 integrally formed with a lower end of the sidewall 12. The bottom 20 generally includes a transition wall 22 extending downwardly and inwardly from the lower end of the sidewall 12 and connecting the sidewall 12 to an annular nose 24 of the container body 10. A center panel 26 extends upwardly and inwardly within the container body 10 and is disposed above the annular nose 24 by an inner wall 36 to complete the bottom 20 of the one-piece container body 10.

Figure 2:
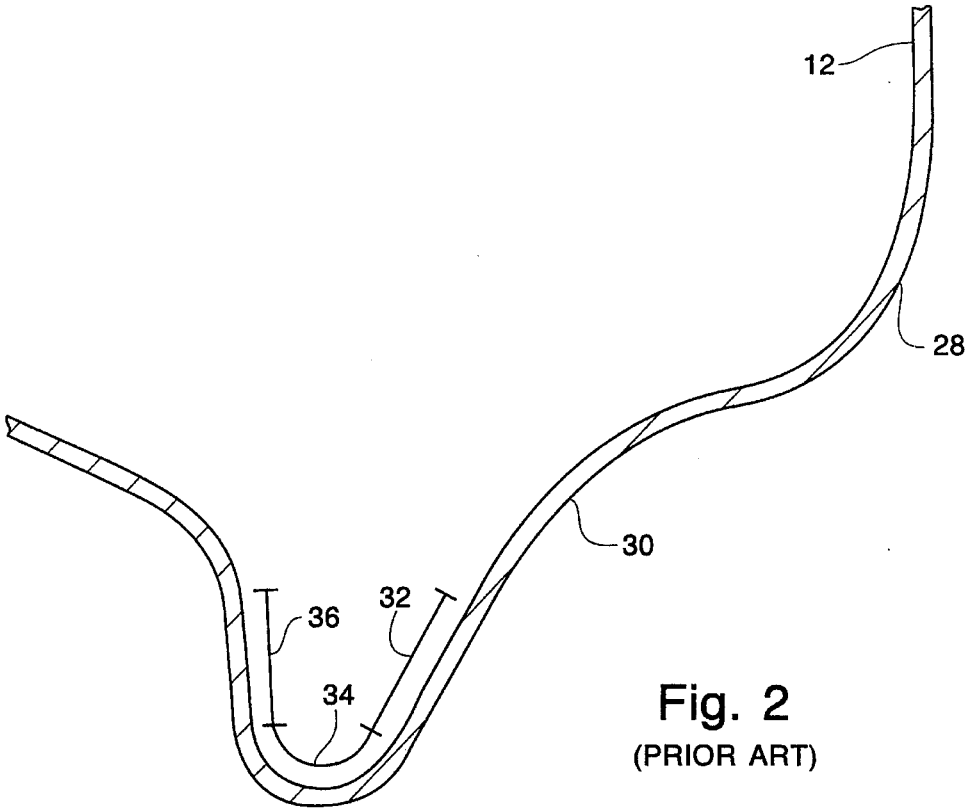
Fig. 2 (PRIOR ART)
FIG. 2 is an enlarged section view of the bottom of the container body illustrated in FIG. 1.

Referring to FIG. 2, the transition wall 22 of many prior art container bodies comprises an exteriorly convex annular portion 28 extending downwardly and inwardly from the sidewall 12, and an exteriorly concave annular portion 30 extending downwardly and inwardly from the convex annular portion 28. As used herein, the terms "convex" and "concave" denote the exterior configuration of the container body 10, unless otherwise noted. In addition, all radii specified herein refer to the radii as taken from the interior of the container body. In can construction, the annular portions 28,30 are typically arcuate. The transition wall 22 concludes with a substantially linear outer wall 32.

The annular nose 24 of the container body 10 is interconnected with the outer wall 32 which extends downwardly and inwardly from the concave annular portion 30and includes a support portion 34 which defines the lower-most surface of the container body 10. The nose 24 is interconnected with an inner wall 36 which extends generally upwardly from the support portion 34 and which is interconnected with the center panel 26. In the illustrated embodiment, the cross-section of the support portion 34 is arcuate, while the cross-sections of both the inner and outer walls 32, 36 are linear or straight. Of course, the inner and outer walls 32, 36 could also be arcuate, rather than straight. From the above, it can be seen that the transition wall 22 and-annular nose 24 of typical container bodies comprise a convex-concave-convex shape defined by the convex portion 28 adjacent to the concave portion 30 adjacent to the convex support portion 34 defining the support surface of the container body 10.

Figure 3:
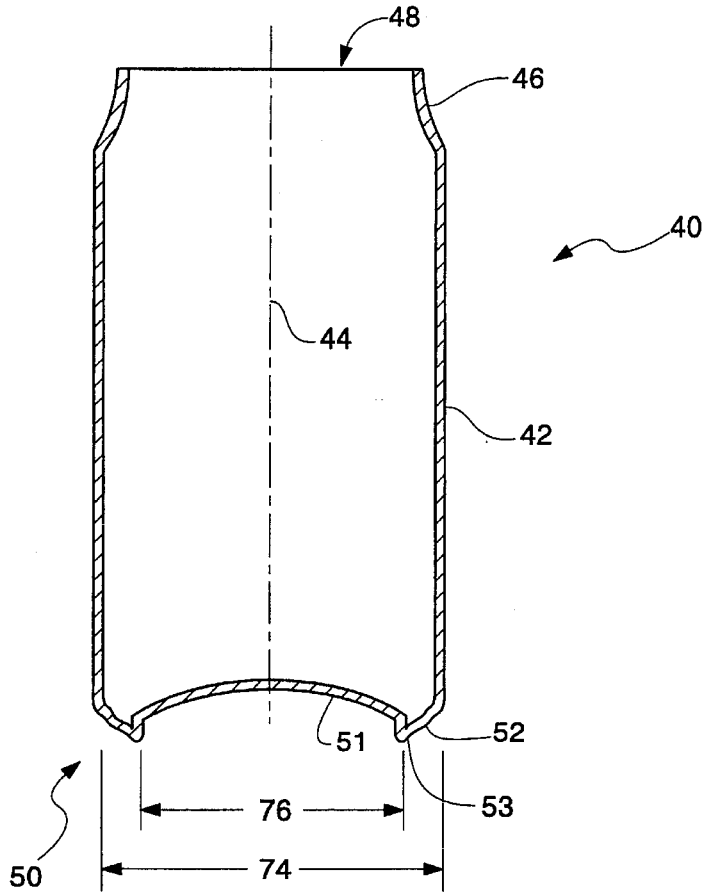
FIG. 3 is section view of a container body embodying the present invention.

FIG. 3 illustrates a transition wall 52 of a beverage container body 40 embodying features of the present invention. As can be seen, rather than including only a single concave annular portion (i.e., as shown in the prior art container body of FIG. 2), the transition wall 52 illustrated in FIG. 3 includes at least two concave portions. Specifically, the transition wall 52 includes a first convex portion 54 adjacent to the sidewall 12, a first concave portion 56 adjacent to the first convex portion 54, a second convex portion 58 adjacent to the first concave portion 56, and a second concave portion 60 adjacent to the second convex portion 58 and interconnected with an annular nose 53. The resulting transition wall 52 has a "wavy" configuration which is believed to provide several distinct advantages, including improved manufacturability, reduced outer die force, and increased life of bodymaker mechanisms, as will be described below in more detail.

Figure 4:
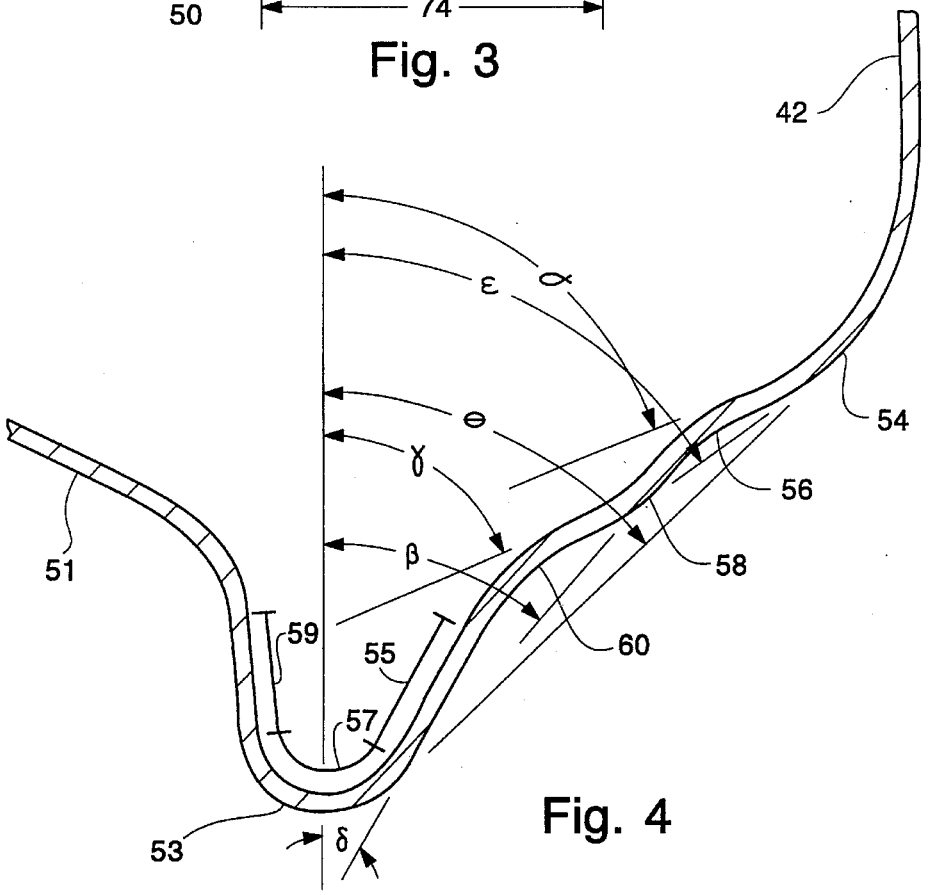
FIG. 4 is an enlarged sectional view of the bottom of the container body illustrated in FIG. 3.

The first convex portion 54 of the embodiment shown in FIG. 4 is arcuate and annular in shape, and preferably has a radius between about 0.05 inches and about 0.30 inches, and more preferably about 0.15 inches. The angle $\alpha$ relative to the central axis 44 at which the first convex portion 54 ceases its travel inwardly can vary considerably without detracting from the beneficial aspects of the present invention. Preferably such angle $\alpha$ ranges from about 35 degrees to about 75 degrees. In FIG. 4, such angle $\alpha$ is about 65 degrees.

The first concave portion 56 has an arcuate and annular shape and has a radius which can vary significantly without detracting from the beneficial features of the invention. Preferably, such radius is within the range of about 0.04 inches to about 0.20 inches, more preferably within the range of about 0.07 inches to about 0.15 inches, and most preferably is about 0.09 inches. In addition, the angle $\beta$ relative to the central axis 44 at which the first concave portion ceases to curve downwardly can vary significantly. Preferably, such angle $\beta$ is between about 25 degrees and about 65 degrees. In the embodiment illustrated in FIG. 4, such angle $\beta$ is about 43 degrees.

The second convex portion 58 is arcuate and annular in shape and has a radius of about 0.13 inches. As with the above-discussed radii, the radius of the second convex portion 58 can vary significantly from that disclosed in the illustrated embodiment. Preferably, such radius ranges from about 0.04 inches to about 0.5 inches, preferably about 0.20 inches. In addition, the angle $\gamma$ relative to the central axis 44 at which the second convex portion ceases its travel inwardly can vary significantly. Preferably, such angle $\gamma$ is between about 58 degrees and about 80 degrees, and more preferably such angle $\gamma$ is about 68 degrees.

The second concave portion 60 is arcuate and annular in shape. It is believed that the radius of the second concave portion 60 can vary significantly from that disclosed in the illustrated embodiment without detracting from the beneficial aspects of the present invention. Preferably, however, such radius is in the range of about 0.04 inches to about 0.25 inches, and more preferably is about 0.15 inches. In addition, the angle $\delta$ relative to the central axis 44 at which the second concave portion ceases its travel downwardly and interconnects with the outer wall of the nose can vary significantly without detracting from the present invention. Preferably, such angle $\delta$ is between about 12 degrees and about 52 degrees. In FIG. 4, such angle $\delta$ is about 32 degrees.

The features of the present invention have been found to be particularly suited to container bodies having a transition wall angle $\epsilon$ within a range of about 35° to about 65°. The transition wall angle $\epsilon$ is defined as the angle between a tangent line, tangent to both the first and second convex portions 54,58, and the central axis 44 of the container body 40. Preferably, such range is between about 35° and about 60° and, in the embodiment of FIG. 4, such angle $\epsilon$ is about 56°.

The nose 53 of the illustrated embodiment is interconnected with an outer wall 55 having a generally straight cross-section and includes a support portion 57 having an arcuate cross-section. The nose 53 is also interconnected with an inner wall 59 having a generally straight cross-section. The nose is positioned at a nose angle $\theta$ defined as the angle between a tangent line, tangent to both the nose 53 and.the first convex portion 54 (or the outer-most convex portion), and the central axis 44 of the container body 40. Such nose angle $\theta$ may, for example, be within a range of about 40° to about 70°. Preferably, the nose angle $\theta$ is between about 44° and about 58° and, in FIG. 4, such angle $\theta$ is about 48°. The radius of the support portion 57 can also vary significantly without adversely affecting the invention. Preferably, the radius varies from about 0.04 to about 0.20 inches. In the illustrated embodiment, the support portion 57 radius is about 0.11 inches.

Figure 5:
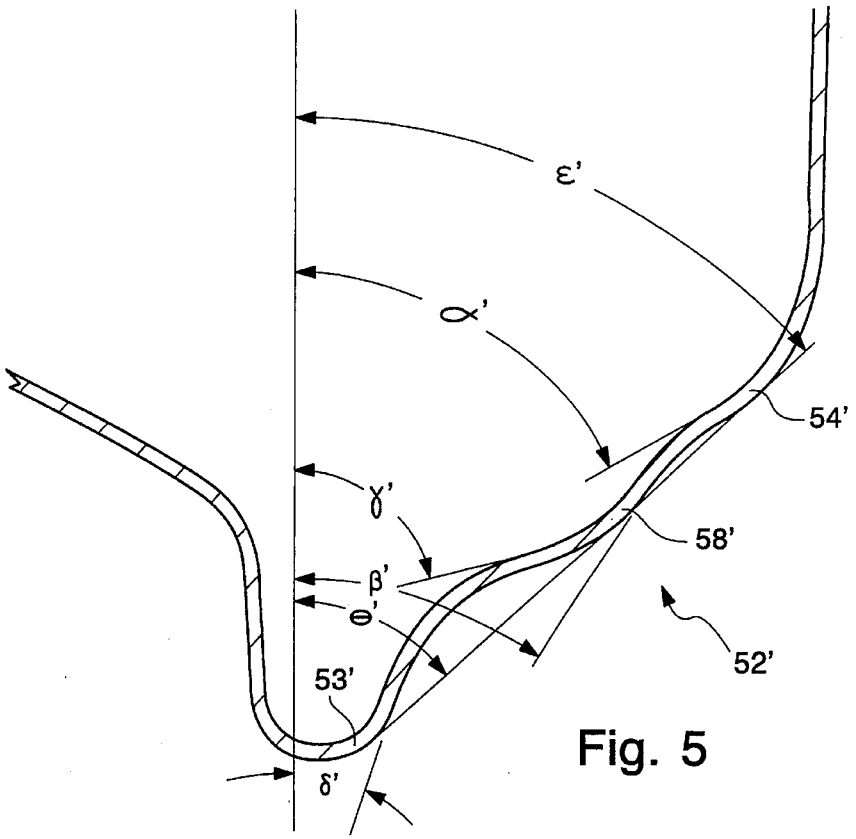
FIG. 5 is an enlarged sectional view of the bottom of a container body illustrating an alternative embodiment of the present invention.

FIG. 5 illustrates an enlarged section view of the bottom of an alternative embodiment of the present invention. FIG. 5 illustrates a transition wall 52' with a second convex portion 58' that is moved outwardly such that it is further outward than a tangent line between the nose 53' and the first convex portion 54'. The result is a nose angle θ' which is defined off of the second convex portion 58' rather than the first convex portion 54', and which is larger than the corresponding transition wall angle ϵ'. In FIG. 5, the nose angle θ' is about 49° and the transition wall angle ϵ' is about 47.5°. In addition, the first convex radius is about 0.15 inches, the first concave radius is about 0.10 inches, the second convex radius is about 0.15 inches, and the second concave radius is about 0.15 inches. The first convex angle α' is about 61.5°, the first concave angle β' is about 35°, the second convex angle γ' is about 76°, and the second concave angle δ' is about 19°.

Figure 6:
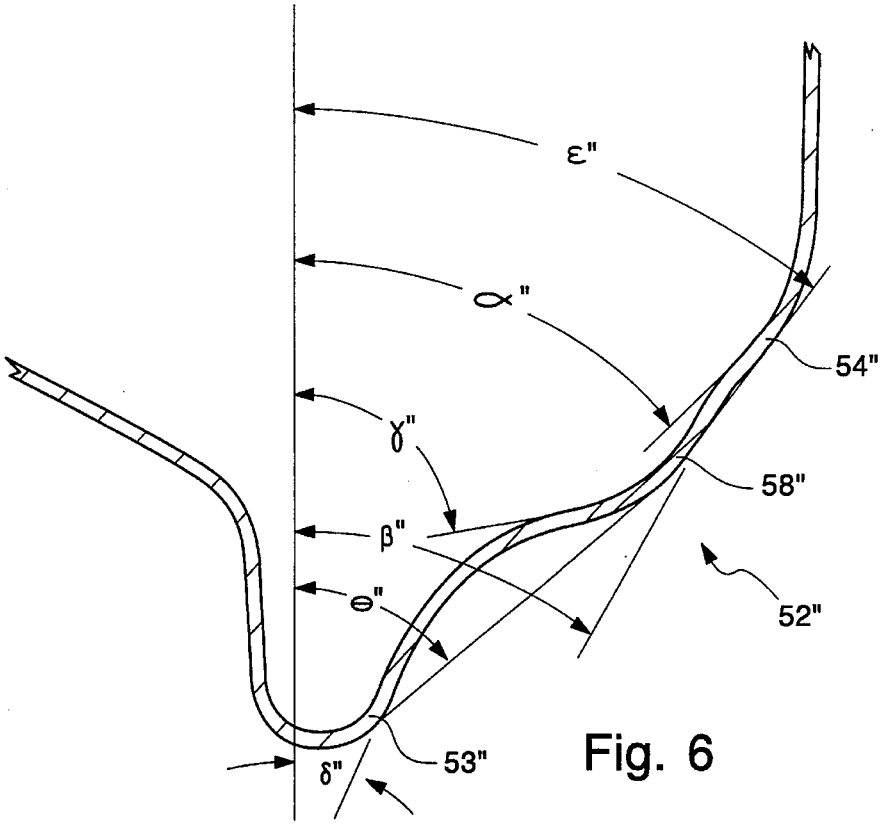
FIG. 6 is an enlarged sectional view of the bottom of a container body illustrating another alternative embodiment of the present invention.

FIG. 6 illustrates an enlarged section view of the bottom of another alternative embodiment of the present invention. FIG. 6 illustrates a transition wall 52" with a second convex portion 58" that is moved further outwardly (i.e., compared to FIGS. 4 and 5) such that it is further outward than a tangent line between the nose 53" and the first convex portion 54". The result is a nose angle ↓" which is defined off of the second convex portion 58" rather than the first convex portion 54", and which is larger than the corresponding transition wall angle ϵ". In FIG. 5, the nose angle θ" is about 50° and the transition wall angle ϵ" is about 37°. In addition, the first convex radius is about 0.20 inches, the first concave radius is about 0.10 inches, the second convex radius is about 0.15 inches, and the second concave radius is about 0.15 inches. The first convex angle α" is about 45.5°, the first concave angle β" is about 30°, the second convex angle γ" is about 80°, and the second concave angle ϵ" is about 25°.

Figure 7:
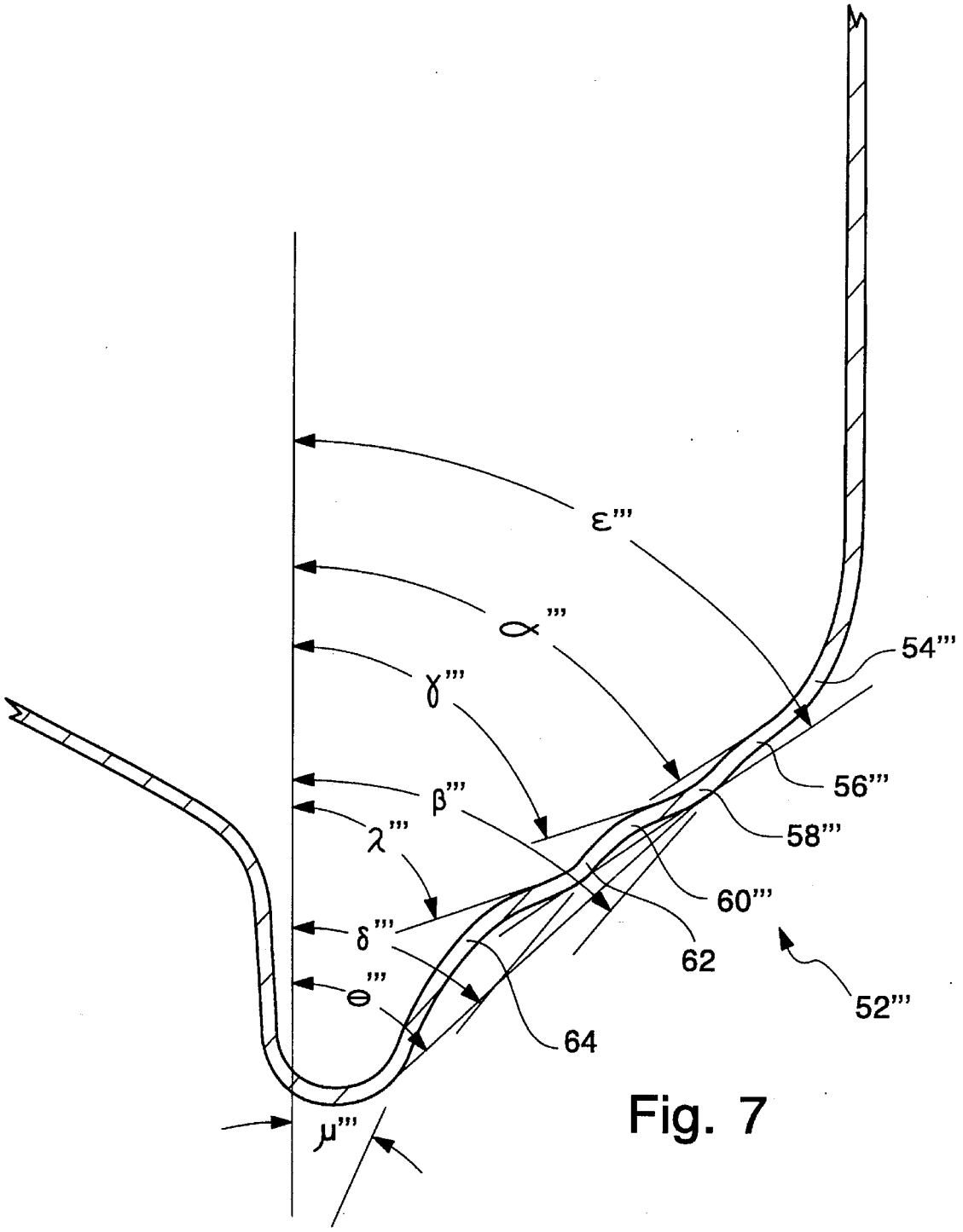
FIG. 7 is an enlarged sectional view of the bottom of a container body illustrating yet another alternative embodiment of the present invention.

FIG. 7 illustrates an enlarged section view of the bottom of yet another alternative embodiment of the present invention. In this embodiment, the transition wall 52''' has three convex portions, rather than just two as in FIGS. 4–6. More specifically, the transition wall 52''' includes a first convex portion 54''' with a radius of about 0.15 inches, a first concave portion 56''' with a radius of about 0.15 inches, a second convex portion 58''' with a radius of about 0.10 inches, a second concave portion 60''' with a radius of about 0.15 inches, a third convex portion 62 with a radius of about 0.10 inches, and a third concave portion 64 with a radius of about 0.15 inches. The nose angle θ''' is about 48.5° and the transition wall angle ϵ''' is about 56°. The first convex angle α''' is about 56.5°, the first concave angle β''' is about 41.5°, the second convex angle γ''' is about 72°, the second concave angle δ''' is about 40.5°, the third convex angle λ''' is about 72°, the third concave angle μ''' is about 24.5°.

The above-described features of the present invention are particularly applicable to aluminum container bodies of the type designed to contain beverages. Referring to FIG. 3, such container bodies typically have a sidewall diameter 74 of between about 2.0 inches and about 4.0 inches or higher. Recently, for example, cans accgmmodating as much as 32 ounces have been developed. In the illustrated embodiment, the sidewall 42 diameter 74 is about 2.615 inches. Correspondingly, such container bodies typically have nose diameters 76 (i.e., the diameter of the annular nose 53 at the bottom most point) of between about 1.8 inches and about 2.0 inches when used with a 2 11/16 inch diameter by 4 13/16 inch tall dimension can. In the illustrated embodiment, the nose diameter 76 is about 1.86 inches.

Figure 8:
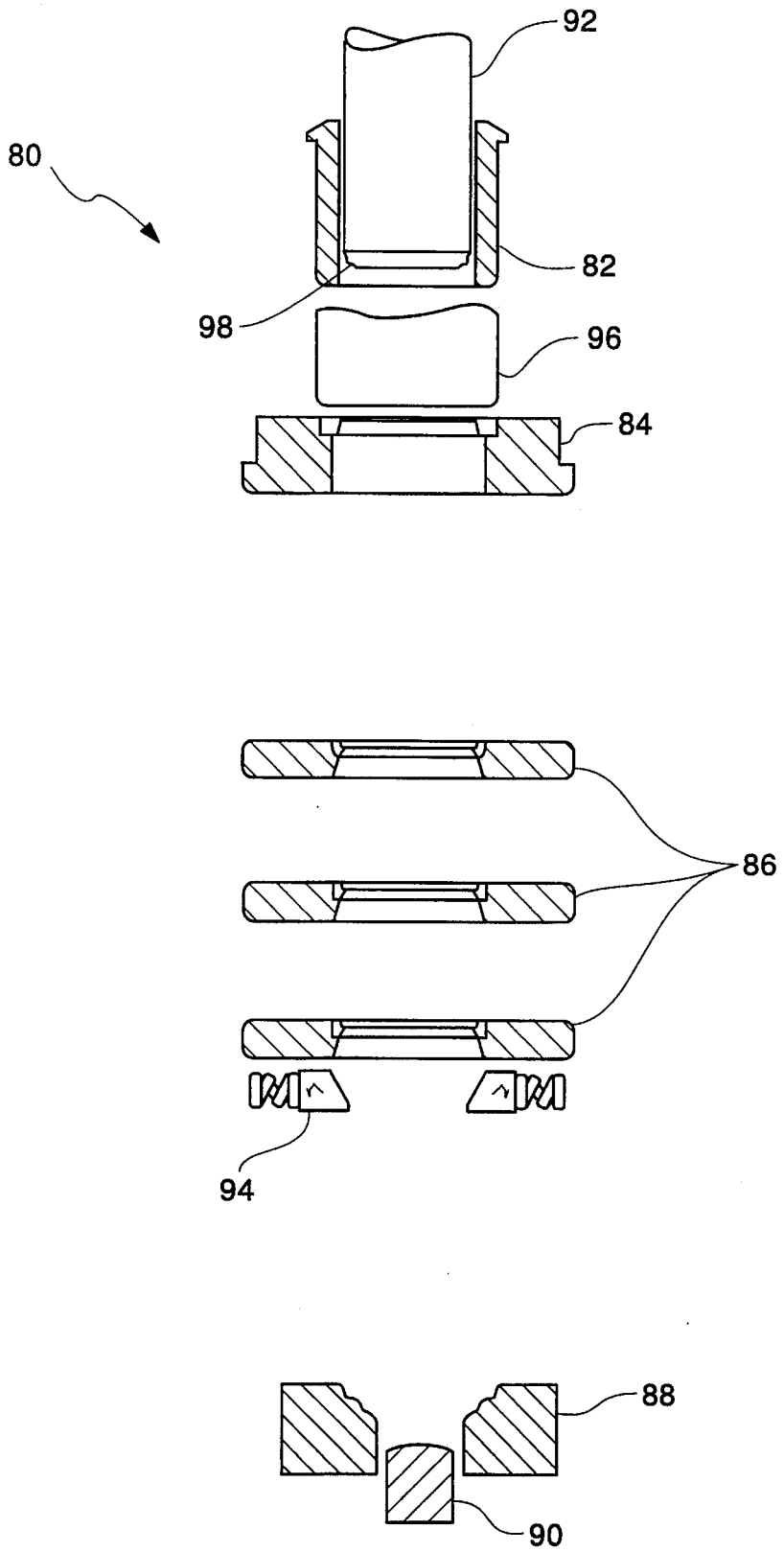
FIG. 8 illustrates a redrawing and ironing apparatus embodying the present invention.

To produce the container body 40 of the present invention, a modified redrawing and ironing apparatus 80 is utilized. Such redrawing and ironing apparatus 80 is similar to prior art apparatuses, except for the provision of multiple convex and concave annular portions in the punch nose and the outer die, as illustrated in FIGS. 8–9. For example, the redrawing and ironing apparatus 80 may include a redraw sleeve 82, a redraw die 84, ironing rings 86, an outer die 88, an inner die 90, and a punch 92. Stripping fingers 94 may be provided to assist in removing the container body 40 from the punch, although forced air has been more recently used as the primary container body stripper with the fingers 94 being used as a backup.

Figure 9A:
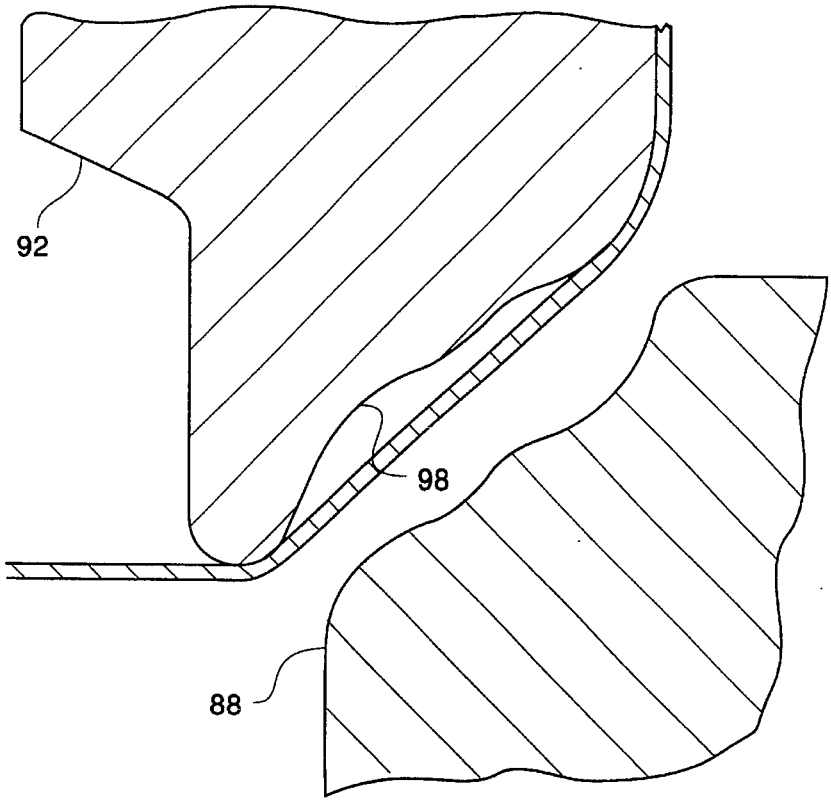
FIG. 9A is an enlarged section view of a punch with a container body positioned thereon, prior to engagement with the outer die.
Figure 9B:
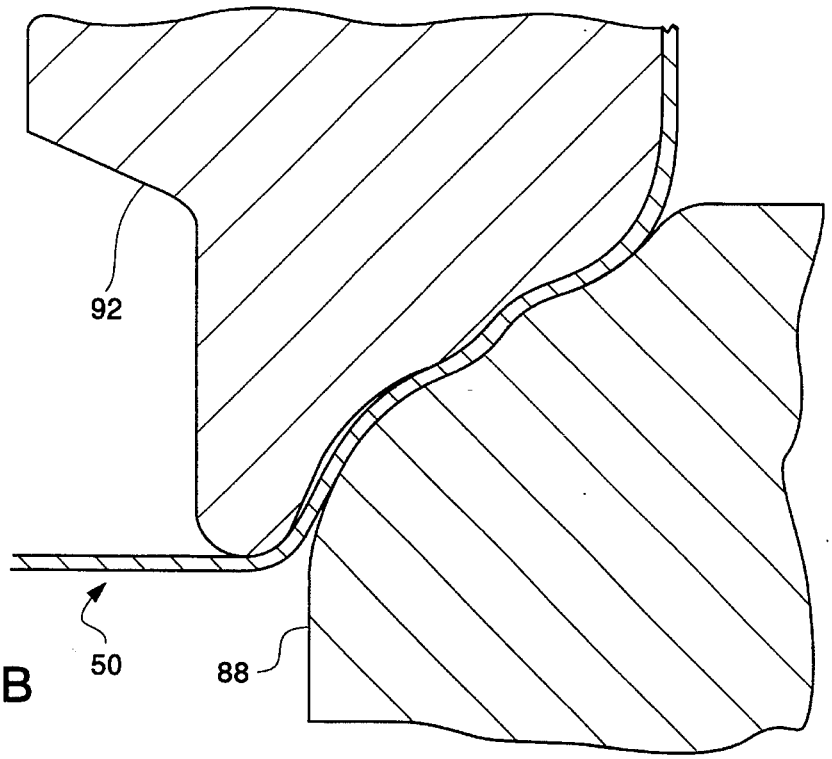
FIG. 9B is the enlarged section view of FIG. 9A with the punch engaging the outer die.
Figure 9C:
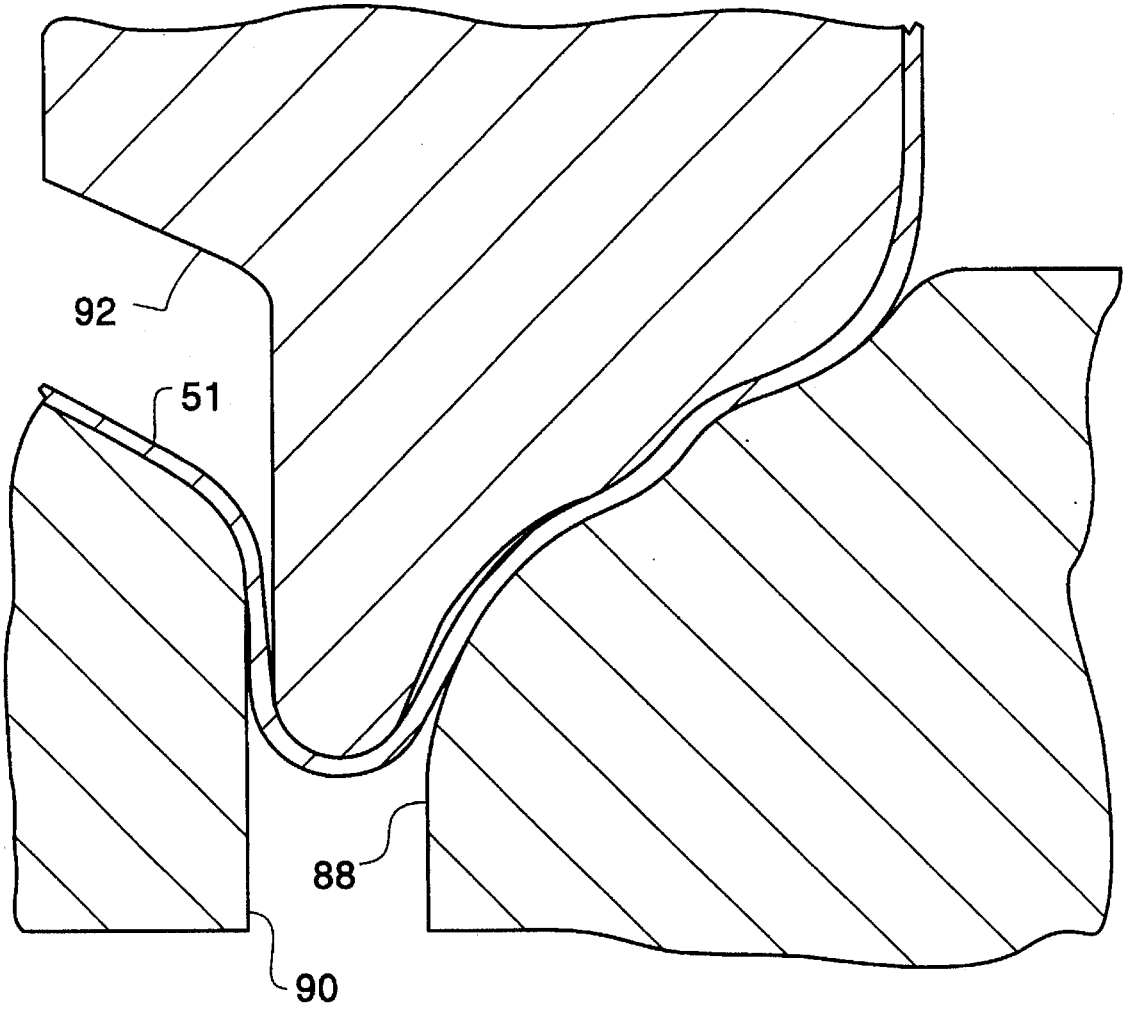
FIG. 9C iis the enlarged section view of FIG. 9B with the inner die fully extended to form the center panel into the bottom of the container body.

Utilizing the above-described apparatus 80, the process for redrawing and ironing a container body 40 is as follows. First, a drawn cup 96 (e.g., formed from a piece of sheet metal stock on a drawing apparatus) is provided to the redrawing and ironing apparatus 80 and positioned over the redraw die 84. The redraw sleeve 82 is then advanced to engage the drawn cup 96 between the redraw sleeve 82 and the redraw die 84. The punch 92 is then advanced to force the drawn cup 96 through the redraw die 84, thereby resulting in a decrease in diameter of the cup. Further advancement of the punch 92 forces the cup through a series of ironing rings 86 to further reduce the sidewall thickness of the cup. After passing through the last ironing ring 86, the punch 92 continues toward the inner and outer dies 90,88 (e.g., the doming dies), as illustrated in FIG. 9A. Further advancement of the punch 92 toward the inner and outer dies 90,88 results in the redrawn cup becoming compressed between the punch nose 98 and the outer die 88 to form a generally wavy configuration in the drawn cup, as illustrated in FIG. 9B. The outer die 88 is spring-loaded (e.g., utilizing an air spring) to provide a generally constant force to engage the drawn cup against the punch nose 98. Further advancement of the punch results in the outer die 88 moving toward the inner die 90 while maintaining a generally constant force against the punch 92. Eventually, the punch 92 and outer die 88 move a sufficient distance such that the inner die 90 is engaged by the bottom 50 of the drawn cup to form the center panel 51 in the container body 40, as illustrated in FIG. 9C. The punch 92 is then withdrawn and the container body 40 removed therefrom by stripping air and/or engagement of the stripping fingers 94 with the open end 48 of the container body 40.

During the formation of the center panel 51, material in the lower end of the sidewall 42 is pulled down between the punch 92 and outer die 88 to provide material for formation of the center panel 51. In typical doming apparatuses, such "pulldown" is typically on the order of about 0.15 inches. During pulldown of the sidewall 42, the material must flow from the larger diameter of the sidewall 42 to the smaller diameter of the transition wall 52. Such change in diameter can result in wrinkling of the material between the punch 92 and the outer die 88. Historically, such wrinkling is substantially prevented by providing sufficient outer die pressure to clamp the transition wall 52 between the punch 92 and the outer die 88. For example, forces on the order of about 1,200 $lb_f$ to about 1,600 $lb_f$ are typically utilized with prior art apparatuses.

In contrast, it has been determined that, by utilizing the apparatus 80 illustrated in FIGS. 8–9 (i.e., having a wavy punch nose 98 and outer die 88 configuration), the outer die forces can be significantly reduced without a significant decrease in performance. Preliminary tests indicate that the outer die force can be less than about 1,000 $lb_f$, and even as low as 500 $lb_f$ or lower utilizing the apparatus described above and illustrated in FIGS. 8–9. More specifically, container bodies formed at 500 $lb_f$ were aesthetically comparable to container bodies formed at standard forces of about 1,200 $lb_f$ to about 1,600 $lb_f$. Without being bound by a theory, it is believed that the ability to reduce the outer die force is the result of maintaining the metal in the transition wall 52 under control during formation of the center panel 51 (i.e., during pulldown of the sidewall 42 through the transition wall 52). That is, passing the metal through small radii tangent to each other provides for bending and unbending of the metal, which aids in metal thickening and/or stretching during diameter reduction. In addition to allowing reduction in outer die forces, the present invention has also been found to increase the tension of the metal across the center panel 51 during formation of the center panel 51. This increase in tension tends to eliminate "flowering" or wrinkling in the center panel 51.

Accordingly, the present invention allows for a reduction in outer die forces during the formation of drawn and ironed container bodies. In addition, due to the decrease in outer die forces, less energy is required during the doming operation. Further, the decrease in outer die forces reduces the wear on the surfaces of the dies, and significantly increases the life of bodymaker mechanisms.

In order to form the tapered neck 46 of the container body 40, numerous necking techniques could be used. Such techniques generally entail the use of external dies and/or rollers which act upon the outside of a container body. As used herein, a "die-necking" operation is an operation wherein a cylindrical container body and inward reducing die are axially aligned and opposingly advanced to force an open end of the container body through the reducing die. The necking processes and apparatuses described herein are not illustrated in the drawings.

In necking processes utilizing external rollers (i.e., "rolling" operations), one or more rollers contact the sidewall of a rotating container body near an open end thereof and are driven radially inward. A cylindrical member is internally and rotatably disposed at the open end of the container body to support the open end during such processes.

Another necking technique is called "spin-flow forming" and is described in U.S. Pat. Nos. 4,563,887 and 4,781,047, which are hereby incorporated by reference in their entirety. In spin-flow forming, two internal members are provided to support and thereby control a rotating container body as an opposing external roller progresses radially inwardly and axially to neck the container, thereby allowing for significant increase in the degree of inward necking that, in practice, can be realized in a single process step. More recently, it was discovered that substantial benefits could be realized by the combinative use of die-necking and spin-flow forming operations. By die-necking prior to spin-flow forming, plug diameter variations in container bodies are substantially reduced prior to spin-flow forming, thereby reducing the likelihood of container body failure during spin-flow forming operations and increasing container uniformity upon spin-flow forming. Such combinative use of die-necking and spin-flow forming operations is disclosed in U.S. Pat. No. 5,138,858, which is hereby incorporated by referenced in its entirety.

The foregoing description of the present invention has been presented for purposes of illustration and description. Furthermore, the description is not intended to limit the present invention to the form disclosed herein. Consequently, variations and modifications of the present invention which are commensurate with the above teachings to those having skill or knowledge of the relevant art, are also within the scope of the present invention. The embodiments described hereinabove are further intended to explain best modes known of practicing the invention to enable others skilled in the art to utilize the invention in such or other embodiments and with the various modifications required by their particular applications or uses of the present invention. It is intended that the appended claims be construed to include alternative embodiments to the extent permitted by the prior art.

What is claimed is:

1. A method for forming a metal container body from a metal blank, said method comprising the steps of:

drawing the blank to form a cup having a sidewall and an integral bottom;

ironing the sidewall of the cup to reduce the wall thickness thereof;

forming at least two annular concave portions in a transition wall of the cup bottom, said transition wall extending generally downwardly and inwardly from a lower end of said sidewall;

upwardly forming a center panel into the cup bottom; and pulling down material through the annular concave portions of the transition wall.

2. A method, as claimed in claim 1, further comprising, after said drawing step, the step of:

redrawing the cup through a redraw die.

3. A method, as claimed in claim 1, wherein said step of ironing comprises reducing the wall thickness of the cup to less than about 0.005 inches.

4. A method, as claimed in claim 1, wherein said step of forming at least two annular concave portions comprises engaging the transition wall of the cup bottom with an outer die at a force of less than about 1,000 $lb_f$.

5. A method, as claimed in claim 1, wherein said step of upwardly forming a center panel comprises forming a domed panel into the cup bottom.

6. A method, as claimed in claim 1, wherein said step of pulling down comprises pulling down material a distance of at least about 0.1 inches.

7. A method, as claimed in claim 1, further comprising the step of:

forming a tapered neck into an upper end of the sidewall.

8. A method, as claimed in claim 2, wherein said redrawing step comprises the steps of:

positioning the cup in alignment with a redraw die; and advancing a punch to force the cup through the redraw die to reduce the diameter of the cup.

9. A method, as claimed in claim 4, wherein said outer die force is less than about 500 $lb_f$.

10. A method of forming a metal container body from a metal blank, said method comprising the steps of:

drawing the blank to form a cup having a sidewall and an integral bottom;

ironing the sidewall of the cup to reduce the wall thickness thereof;

engaging a transition wall of the cup bottom with an outer die at a force of less than about 1,000 $lb_f$, said engaging step comprising forming at least two annular concave portions in the transition wall of the cup bottom; and upwardly forming a center panel into the cup bottom.

11. A method, as claimed in claim 10, wherein said ironing step comprises disposing a punch in an interior of the cup and advancing the cup through a plurality of ironing rings.

12. A method, as claimed in claim 10, wherein said applying step comprises applying a force of less than about 500 $lb_f$.

13. A method, as claimedin claim 10, further comprising the step of:

pulling down material through the annular concave portions of the transition wall.

14. A method, as claimed in claim 10, further comprising, after said drawing step, the step of:

redrawing the cup through a redraw die.

15. A method, as claimed in claim 10, wherein said step of ironing comprises reducing the wall thickness of the cup to less than about 0.005 inches.

16. A method, as claimed in claim 10, wherein said step of upwardly forming a center panel comprises forming a domed panel into the cup bottom.

17. A method, as claimed in claim 10, further comprising:

forming a tapered neck into an upper end of the sidewall.

18. A method, as claimed in claim 13, wherein said step of pulling down comprises pulling down material a distance of at least about 0.1 inches.

19. A method, as claimed in claim 14, wherein said redrawing step comprises:

positioning the cup in alignment with a redraw die; and advancing a punch to force the cup through the redraw die to reduce the diameter of the cup.

20. A method, as claimed in claim 11, wherein said configuring step comprises using said applying step to substantially conform the transition wall to a corresponding portion of the punch.

21. A method, as claimed in claim 20, wherein the corresponding portion of the punch comprises two annular concave portions which are spaced.

22. A method, as claimed in claim 14, wherein said ironing step is performed after said redrawing step and said engaging step is performed after said redrawing step.

* * * * *